US010698343B2

(12) United States Patent
Kinoshita

(10) Patent No.: US 10,698,343 B2
(45) Date of Patent: Jun. 30, 2020

(54) DEVELOPER REPLENISHMENT CONTAINER

(71) Applicant: KONICA MINOLTA, INC., Chiyoda-ku, Tokyo (JP)

(72) Inventor: Takeru Kinoshita, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/545,088

(22) Filed: Aug. 20, 2019

(65) Prior Publication Data

US 2020/0081372 A1 Mar. 12, 2020

(30) Foreign Application Priority Data

Sep. 12, 2018 (JP) ..... 2018-170547

(51) Int. Cl.
*G03G 15/08* (2006.01)

(52) U.S. Cl.
CPC ..... *G03G 15/0867* (2013.01); *G03G 15/0886* (2013.01)

(58) Field of Classification Search
CPC ..... G03G 15/0867; G03G 15/0886
See application file for complete search history.

(56) References Cited

U.S. PATENT DOCUMENTS

2012/0014713 A1* 1/2012 Murakami ..... G03G 15/0865 399/119

FOREIGN PATENT DOCUMENTS

JP 2013213910 A 10/2013

* cited by examiner

*Primary Examiner* — David M. Gray
*Assistant Examiner* — Michael A Harrison
(74) *Attorney, Agent, or Firm* — Buchanan Ingersoll & Rooney PC

(57) ABSTRACT

A developer replenishment container attachable to and detachable from a container receiver of a developer supply device is provided. The developer replenishment container includes a containing cover portion, a containing portion, and a discharge mechanism configured to deliver a developer to a discharge port while loosening the developer. The containing portion has a circumferential wall and a rotational force input portion. The circumferential wall is provided with a spiral protrusion. The discharge mechanism has a cam member and a biasing member including a bellows portion. A discharge channel is formed between the cam member and the bellows portion. The bellows portion extends and contracts in accordance with reciprocating movement of the cam member along an axial direction of the circumferential wall.

18 Claims, 19 Drawing Sheets

DEVELOPER REPLENISHMENT CONTAINER

The entire disclosure of Japanese Patent Application No. 2018-170547, filed on Sep. 12, 2018, is incorporated herein by reference in its entirety.

BACKGROUND

Technological Field

The present invention relates to a developer replenishment container.

Description of the Related Art

Japanese Laid-Open Patent Publication No. 2013-213910, for example, discloses a toner bottle (developer replenishment container) attachable to and detachable from a container receiver of a developer supply device. The developer replenishment container includes a cover portion having a discharge port through which to discharge toner (developer), and a containing portion configured to contain the toner and held by the cover portion so as to be able to rotate relative to the cover portion. The containing portion is formed in a cylindrical shape. The containing portion is provided with a protrusion protruding inward and formed in a spiral shape in an axial direction of the containing portion. The containing portion is driven to rotate by a toner bottle drive unit of the developer supply device. As a result, the protrusion conveys the toner toward the discharge port.

SUMMARY

The developer replenishment container as is described in Japanese Laid-Open Patent Publication No. 2013-213910 poses a risk that, when attached to or detached from the developer supply device, the developer that has flown out through the discharge port may adhere to the developer supply device. Thus, the size of the discharge port may be reduced. Such size reduction, however, may cause clogging of the discharge port with the developer, and the resulting failure to replenish the developer.

An object of the present invention is to provide a developer replenishment container capable of suppressing the occurrence of clogging of a discharge port with a developer.

A developer replenishment container according to one aspect of the present invention is a developer replenishment container attachable to and detachable from a container receiver of a developer supply device. This developer replenishment container includes: a containing cover portion having a discharge port through which to discharge a developer; a containing portion configured to contain the developer and held by the containing cover portion so as to be able to rotate relative to the containing cover portion; and a discharge mechanism configured to deliver the developer in the containing portion to the discharge port while loosening the developer. The containing portion has a circumferential wall formed in a cylindrical shape, and a rotational force input portion configured to receive a rotational force for rotating the circumferential wall around its axis from a drive unit of the developer supply device. The circumferential wall is provided with a spiral protrusion shaped to protrude inward and extend spirally. The discharge mechanism has a cam member displaceable along an axial direction of the circumferential wall on an inner side of the containing cover portion while engaging the spiral protrusion during rotation of the containing portion, and a biasing member including a bellows portion configured to generate a biasing force for biasing the cam member toward the spiral protrusion. A discharge channel connecting an inside of the containing portion and the discharge port and configured to discharge the developer is formed between the cam member and the bellows portion. The bellows portion is configured to extend and contract in accordance with reciprocating movement of the cam member along the axial direction of the circumferential wall.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
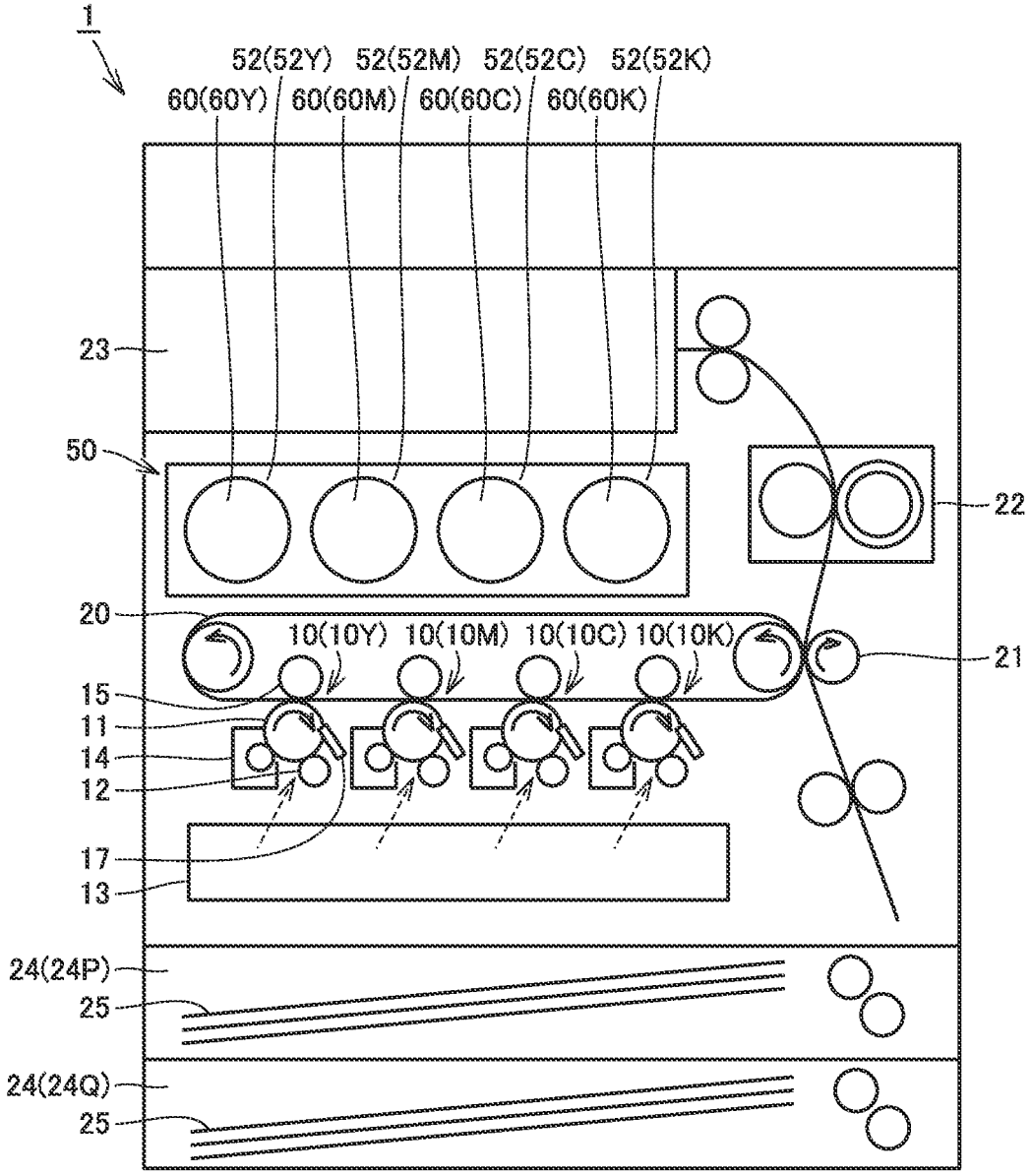
FIG. 1 schematically shows an overall configuration of an image forming apparatus including a developer replenishment container of a first embodiment of the present invention.

Hereinafter, one or more embodiments of the present invention will be described with reference to the drawings. However, the scope of the invention is not limited to the disclosed embodiments. It should be noted that the same or corresponding components are denoted by the same numbers in the drawings referenced below.

First Embodiment

FIG. 1 schematically shows an overall configuration of an image forming apparatus including a developer replenishment container of a first embodiment of the present invention. This image forming apparatus 1 is a multifunctional peripheral (MFP) having a plurality of functions such as a copy function, a facsimile function, a printer function and a scanner function.

As shown in FIG. 1, image forming apparatus 1 has image forming units 10 (10Y, 10M, 10C, 10K), an intermediate transfer belt 20, a secondary transfer roller 21, a fixing device 22, a paper output tray 23, paper feed trays 24 (24P, 24Q), and a developer supply device 50.

Each image forming unit 10 has a photoreceptor 11 (image carrier), a charging device 12, an exposing device 13, a developing device 14, a primary transfer roller 15, and a cleaning blade 17. Image forming unit 10Y, image forming unit 10M, image forming unit 10C and image forming unit 10K form toner images having the colors of yellow (Y), magenta (M), cyan (C) and black (K), respectively, onto a surface of intermediate transfer belt 20.

The toner images of the respective colors are superimposed on the surface of intermediate transfer belt 20. Intermediate transfer belt 20 then conveys a colored toner image to a secondary transfer unit between intermediate transfer belt 20 and secondary transfer roller 21.

Paper feed trays 24 are provided as storage units to store sheets of paper 25 as recording media. Paper feed trays 24 store a plurality of sheets of paper 25. Typically, paper feed tray 24P and paper feed tray 24Q store sheets of paper 25 of different sizes from each other. Paper feed tray 24P and paper feed tray 24Q are arranged vertically side by side.

While paper feed trays 24 are described as being provided as vertical two stages in the present embodiment, this is not restrictive. One-staged paper feed tray 24 or at least three-staged paper feed trays 24 may also be provided.

A sheet of paper 25 contained in paper feed tray 24 is conveyed by various types of rollers to the secondary transfer unit between intermediate transfer belt 20 and secondary transfer roller 21. The colored toner image carried by intermediate transfer belt 20 is transferred onto a surface of the sheet of paper 25 at the secondary transfer unit. The colored toner image is fixed onto the surface of the sheet of paper 25 by fixing device 22. The sheet of paper 25 with an image printed thereon through the steps above is discharged to paper output tray 23.

Developer supply device 50 is a device to supply a developer (toner) to developing device 14 of image forming unit 10. Developer supply device 50 is provided between intermediate transfer belt 20 and paper output tray 23 in the vertical direction. However, the arrangement of developer supply device 50 in image forming apparatus 1 is not particularly limited.

Figure 2:
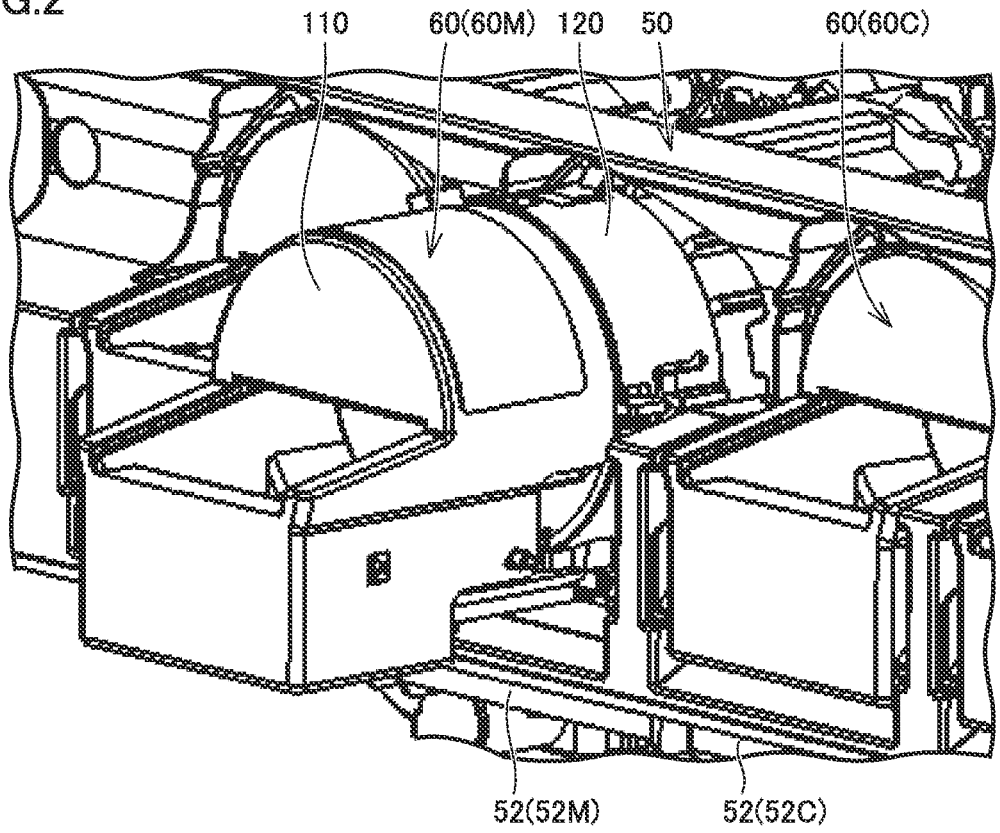
FIG. 2 is a partially-enlarged perspective view of a developer supply device.
Figure 3:
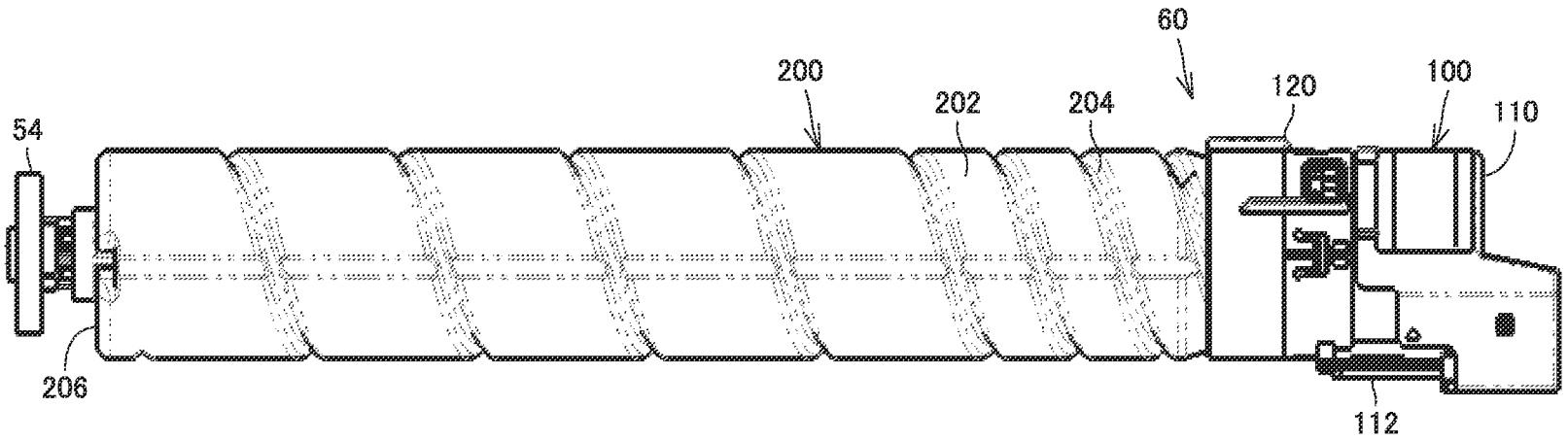
FIG. 3 is a side view of the developer replenishment container and a rotational force transmission unit.
Figure 4:
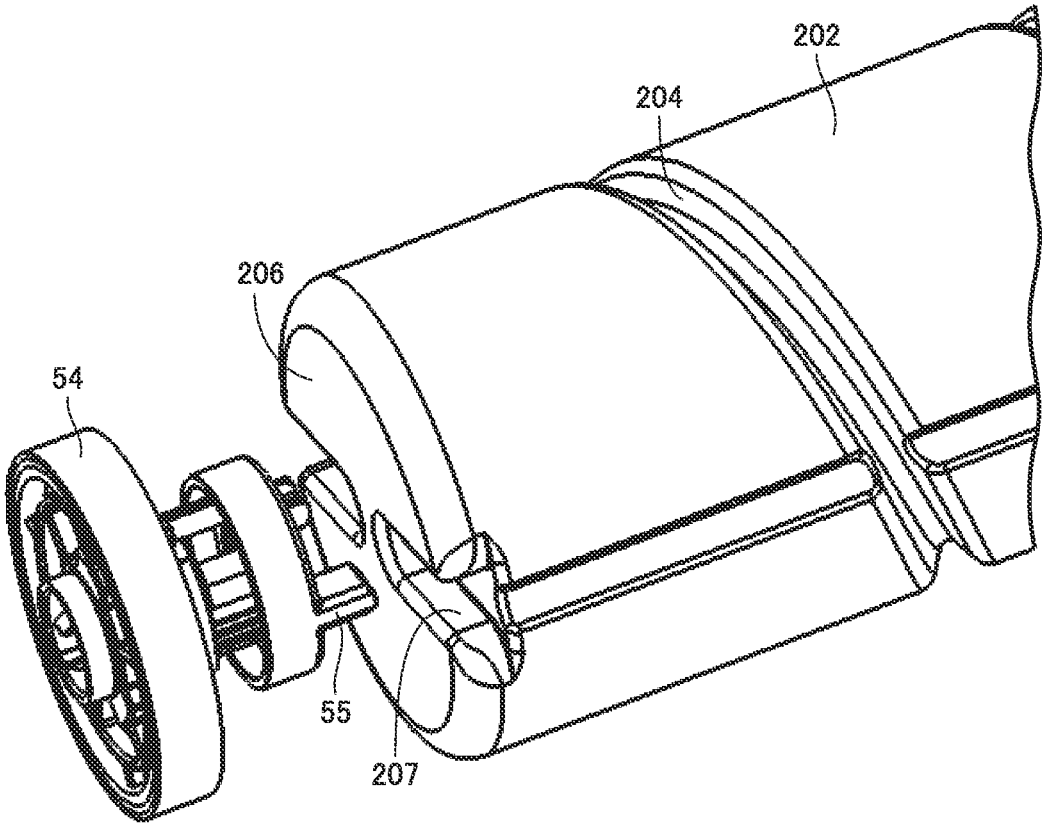
FIG. 4 is an enlarged perspective view showing relation between the developer replenishment container and the rotational force transmission unit.

FIG. 2 is a partially-enlarged perspective view of the developer supply device. FIG. 3 is a side view of the developer replenishment container and a rotational force transmission unit. FIG. 4 is an enlarged perspective view showing relation between the developer replenishment container and the rotational force transmission unit. As shown in FIGS. 1 to 4, developer supply device 50 has container receivers 52 (52Y, 52M, 52C, 52K), a rotational force transmission unit 54, a drive unit (not shown), and developer replenishment containers 60 (60Y, 60M, 60C, 60K).

Container receivers 52 are disposed above intermediate transfer belt 20 in image forming apparatus 1. Container receivers 52 are configured to receive developer replenishment containers 60. Container receiver 52Y, container receiver 52M, container receiver 52C and container receiver 52K are provided to correspond to developer replenishment container 60Y, developer replenishment container 60M, developer replenishment container 60C and developer replenishment container 60K, respectively.

Rotational force transmission unit 54 is shaped to fit into developer replenishment container 60. When fitted into developer replenishment container 60, rotational force transmission unit 54 transmits a rotational force for rotating developer replenishment container 60 to this developer replenishment container 60. As shown in FIG. 4, rotational force transmission unit 54 has a fitting protrusion 55. This rotational force transmission unit 54 is driven to rotate by the drive unit not shown in the figure.

Developer replenishment container 60 contains a developer (toner) to be replenished to developing device 14. Developer replenishment container 60Y, developer replenishment container 60M, developer replenishment container 60C and developer replenishment container 60K are provided to correspond to image forming unit 10Y, image forming unit 10M, image forming unit 10C and image forming unit 10K, respectively. That is, developer replenishment container 60Y, developer replenishment container 60M, developer replenishment container 60C and developer replenishment container 60K contain toners of the colors of yellow (Y), magenta (M), cyan (C) and black (K), respectively.

Developer replenishment container 60 is driven to rotate by the drive unit through rotational force transmission unit 54, to thereby replenish the developer to developing device 14. Developer replenishment container 60 is configured to be attached to and detached from container receiver 52. When the remaining amount of developer in developer replenishment container 60 is low, developer replenishment container 60 is detached from container receiver 52, and a new developer replenishment container 60 containing a sufficient amount of developer is mounted on container receiver 52.

Figure 5:
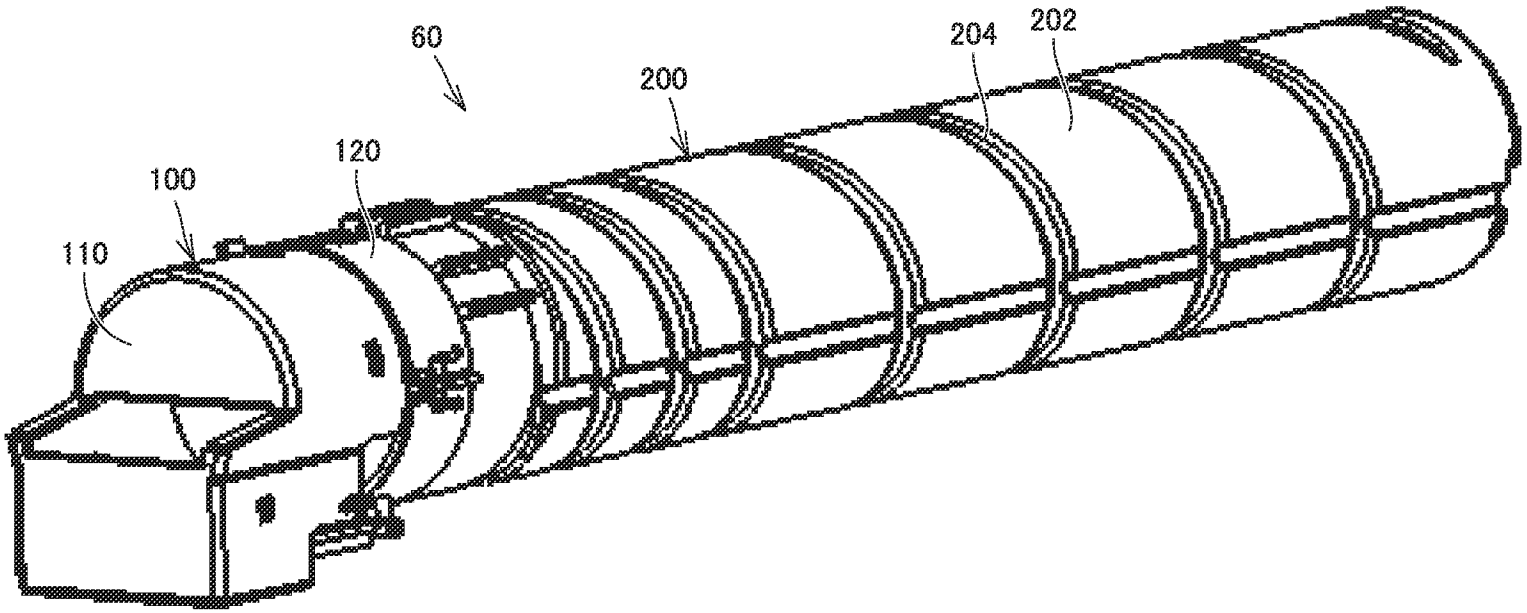
FIG. 5 is a perspective view of the developer replenishment container.
Figure 6:
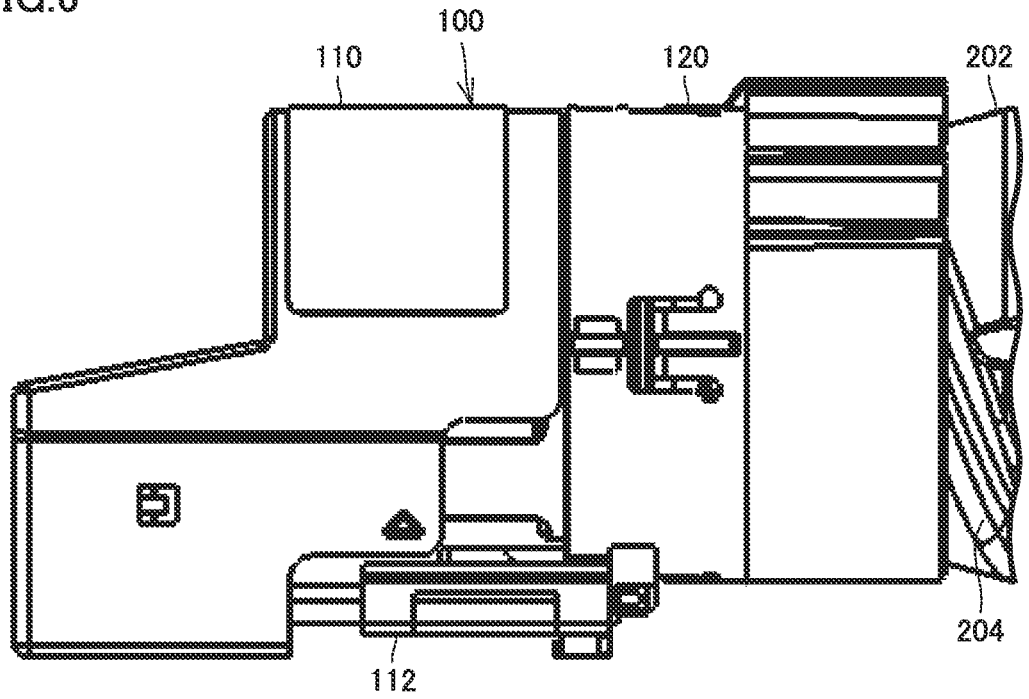
FIG. 6 is a partially-enlarged side view of the developer replenishment container.
Figure 7:
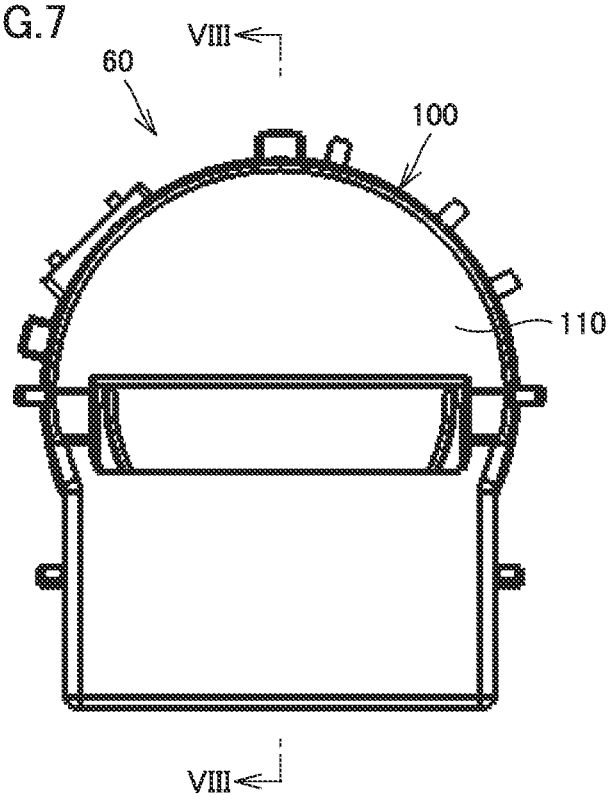
FIG. 7 is a front view of the developer replenishment container.
Figure 8:
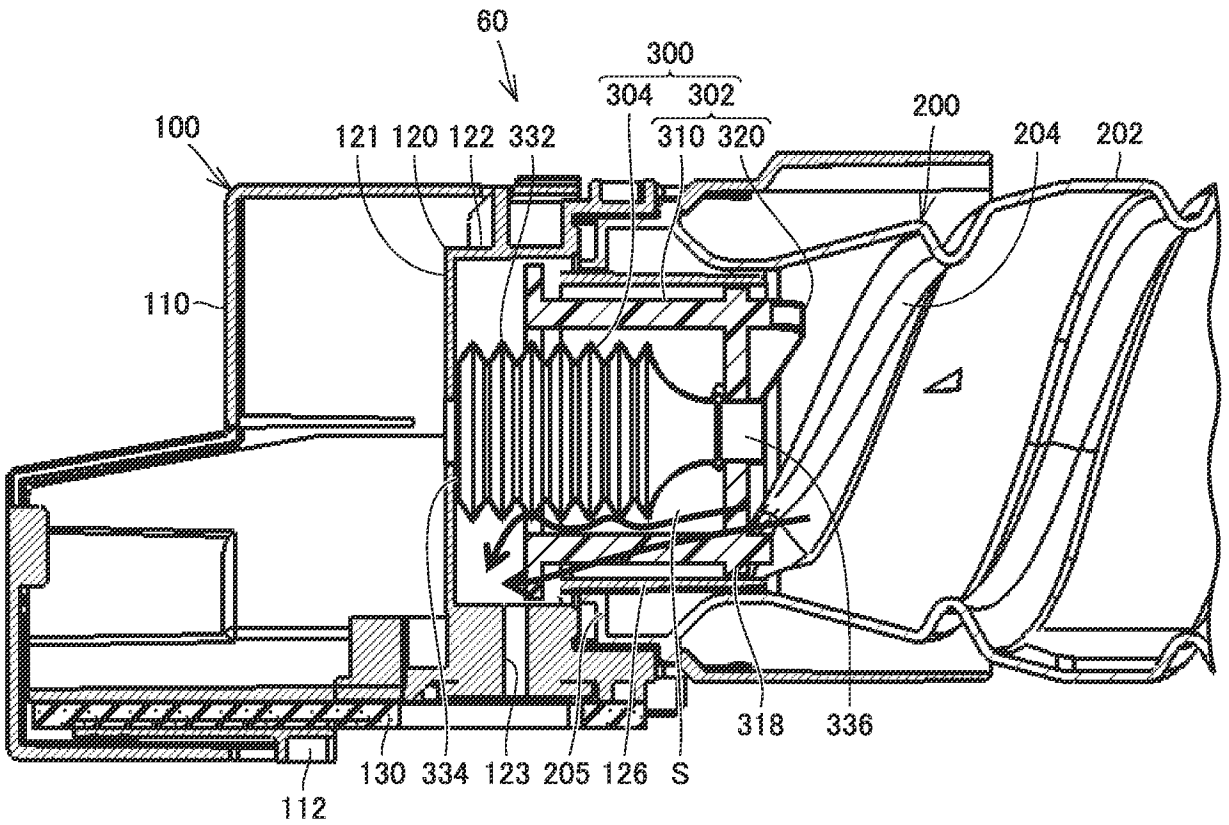
FIG. 8 is a cross-sectional view taken along a line VIII-VIII shown in FIG. 7, with a bellows portion in an extended state.
Figure 9:
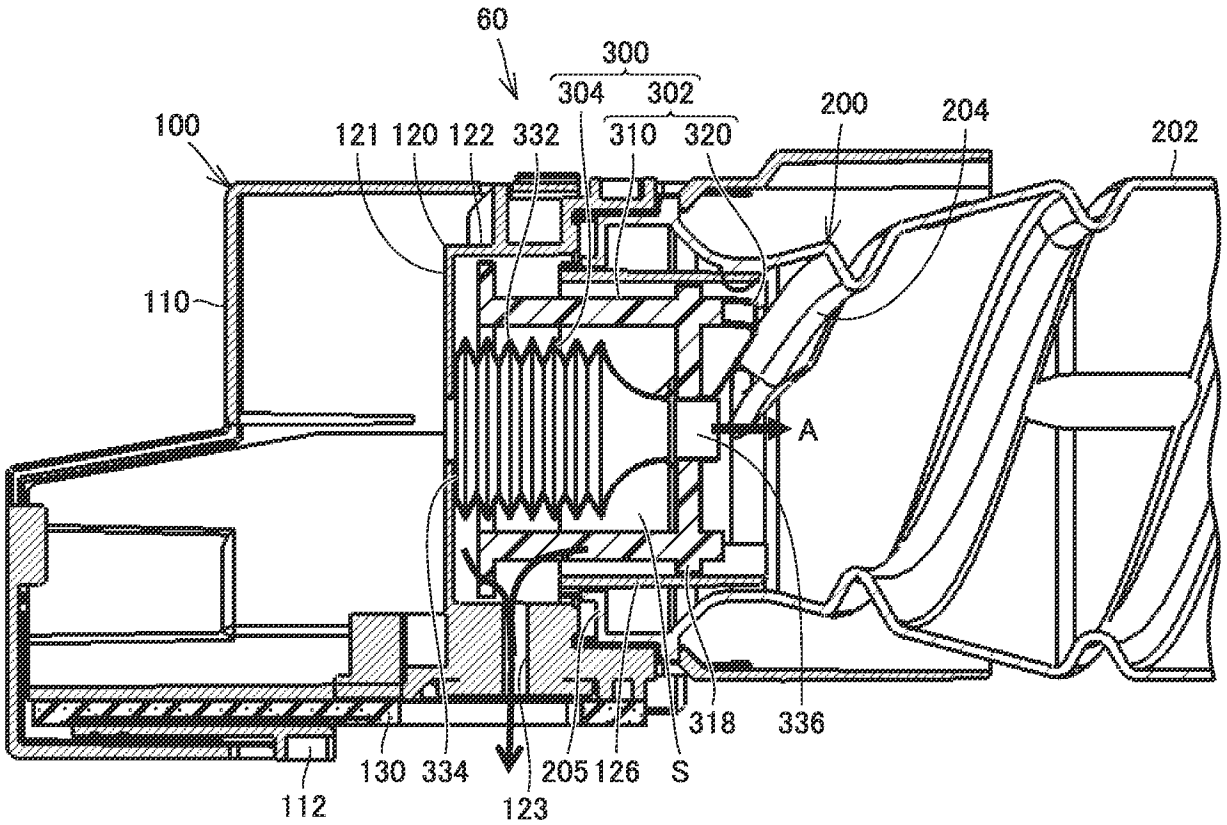
FIG. 9 shows the bellows portion in a contracted state in FIG. 8.

FIG. 5 is a perspective view of the developer replenishment container. FIG. 6 is a partially-enlarged side view of the developer replenishment container. FIG. 7 is a front view of the developer replenishment container. FIG. 8 is a cross-sectional view taken along a line VIII-VIII shown in FIG. 7, with a bellows portion in an extended state. FIG. 9 shows the bellows portion in a contracted state in FIG. 8.

As shown in FIGS. 5 to 9, developer replenishment container 60 has a cover member 100, a containing portion 200, and a discharge mechanism 300.

Cover member 100 has an operation cover portion 110, a containing cover portion 120, and a seal material 130.

Operation cover portion 110 is a portion to be operated by an operator such as during attachment or detachment of developer replenishment container 60. Operation cover portion 110 is disposed at the front of cover member 100. Operation cover portion 110 has a shutter 112.

Containing cover portion 120 is disposed behind operation cover portion 110. Containing cover portion 120 contains a portion of containing portion 200. Containing cover portion 120 holds containing portion 200 so that containing portion 200 can rotate relative to this containing cover portion 120. Containing cover portion 120 is formed integrally with operation cover portion 110. However, containing cover portion 120 may be formed as a separate member from operation cover portion 110. Containing cover portion 120 has a front wall 121, a cylindrical wall 122, a containing portion holding portion 126, and a guide portion 128.

Front wall 121 is disposed on the front side (the operation cover portion 110 side). Front wall 121 is formed in a disk shape. Front wall 121 is parallel to the vertical direction when developer replenishment container 60 is mounted on container receiver 52.

Cylindrical wall 122 is shaped to rise rearward from an outer edge portion of front wall 121. Cylindrical wall 122 is formed in a cylindrical shape. Cylindrical wall 122 is connected to operation cover portion 110. The inside of cylindrical wall 122 and the inside of operation cover portion 110 are partitioned from each other by front wall 121. Cylindrical wall 122 is provided with a discharge port 123 through which to discharge the developer. Discharge port 123 extends through cylindrical wall 122 in its radial direction. Cover member 100 is mounted on container receiver 52 so that this discharge port 123 faces the vertical direction.

Containing portion holding portion 126 is a portion to hold containing portion 200. Containing portion holding portion 126 is shaped to extend along an axial direction of cylindrical wall 122 from this cylindrical wall 122 to the side (rearward) opposite to the side on which front wall 121 is located.

Guide portion 128 guides a cam member 302 which will be described later. Guide portion 128 is shaped to extend inward in the radial direction of cylindrical wall 122 from an inner circumferential surface of cylindrical wall 122, and to extend along the axial direction of cylindrical wall 122. A pair of guide portions 128 is connected to two portions of the inner circumferential surface of cylindrical wall 122 that face each other in the radial direction of cylindrical wall 122.

Seal material 130 is fixed to the bottoms of operation cover portion 110 and cylindrical wall 122. Seal material 130 overlaps discharge port 123 in the radial direction of cylindrical wall 122, and is provided with a hole larger than discharge port 123. Shutter 112 is movable between a position to open this hole (the position of FIG. 8) and a position to close this hole.

Containing portion 200 contains the developer. Containing portion 200 is held by containing cover portion 120 so as to be able to rotate relative to containing cover portion 120. Containing portion 200 is attachable to and detachable from cover member 100. Specifically, containing portion 200 has a circumferential wall 202, a held portion 205, and a bottom wall 206.

Circumferential wall 202 is formed in a cylindrical shape. Circumferential wall 202 is provided with a spiral protrusion 204 shaped to protrude inward and extend spirally.

Held portion 205 is a portion to be held by containing portion holding portion 126 of containing cover portion 120. Held portion 205 is connected to one end (on the side held by containing cover portion 120) of circumferential wall 202. Held portion 205 is held by containing portion holding portion 126 so as to be able to rotate relative to containing portion holding portion 126. Held portion 205 is shaped to open the inside of circumferential wall 202 to the outside. As shown in FIGS. 8 and 9, held portion 205 faces front wall 121 while being held by containing portion holding portion 126.

As shown in FIGS. 3 and 4, bottom wall 206 is connected to the other end of circumferential wall 202. Bottom wall 206 is shaped to close the other opening in circumferential wall 202. As shown in FIG. 4, bottom wall 206 has a rotational force input portion 207. Rotational force input portion 207 is shaped to be recessed toward held portion 205, and to fit with fitting protrusion 55 of rotational force transmission unit 54. Rotational force input portion 207 receives from rotational force transmission unit 54 a rotational force for rotating circumferential wall 202 around its axis. That is, the drive unit rotates while fitting protrusion 55 is fitted into rotational force input portion 207, causing containing portion 200 to rotate relative to containing cover portion 120 around the central axis of circumferential wall 202. As a result, the developer in containing portion 200 is delivered toward held portion 205 and discharge port 123 by spiral protrusion 204.

Discharge mechanism 300 is a mechanism to deliver the developer in containing portion 200 to discharge port 123 while loosening the developer. Discharge mechanism 300 is provided on the inner side of containing cover portion 120. Specifically, discharge mechanism 300 has cam member 302 and a biasing member 304.

Figure 10:
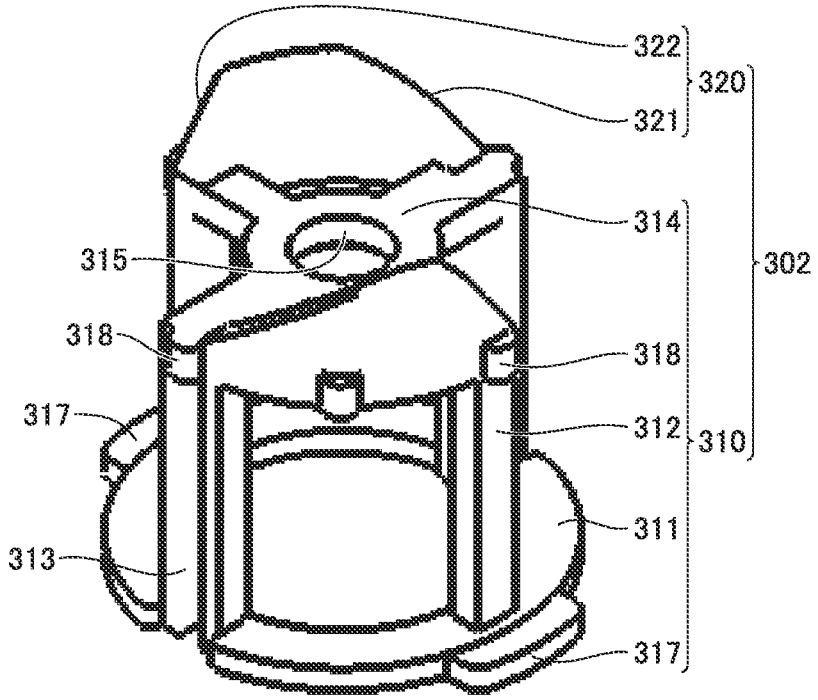
FIG. 10 is a perspective view of a cam member.
Figure 11:
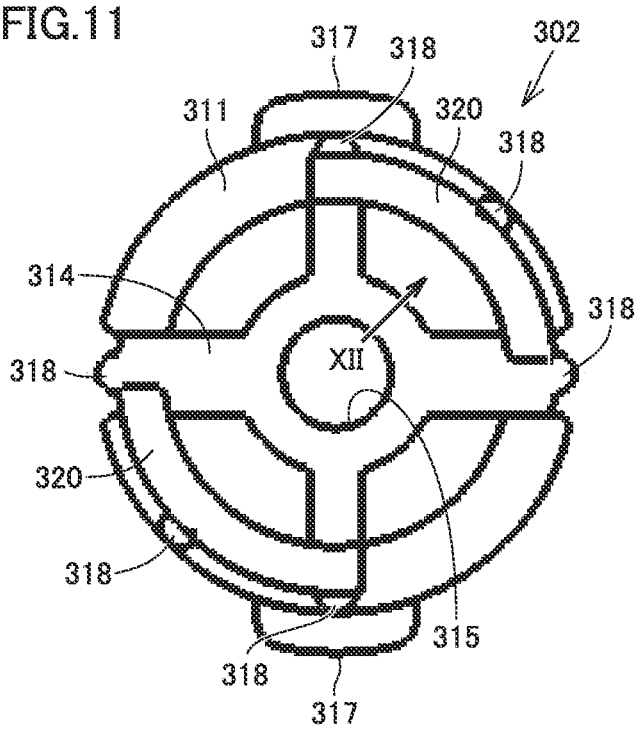
FIG. 11 is a plan view of the cam member.
Figure 12:
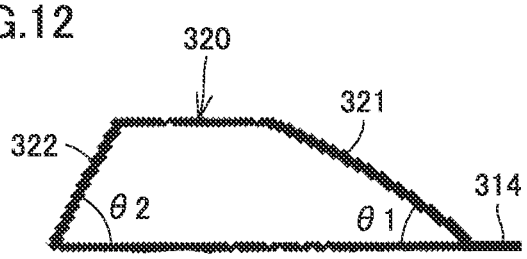
FIG. 12 shows a cam portion viewed in a direction indicated by an arrow XII in FIG. 11.
Figure 13:
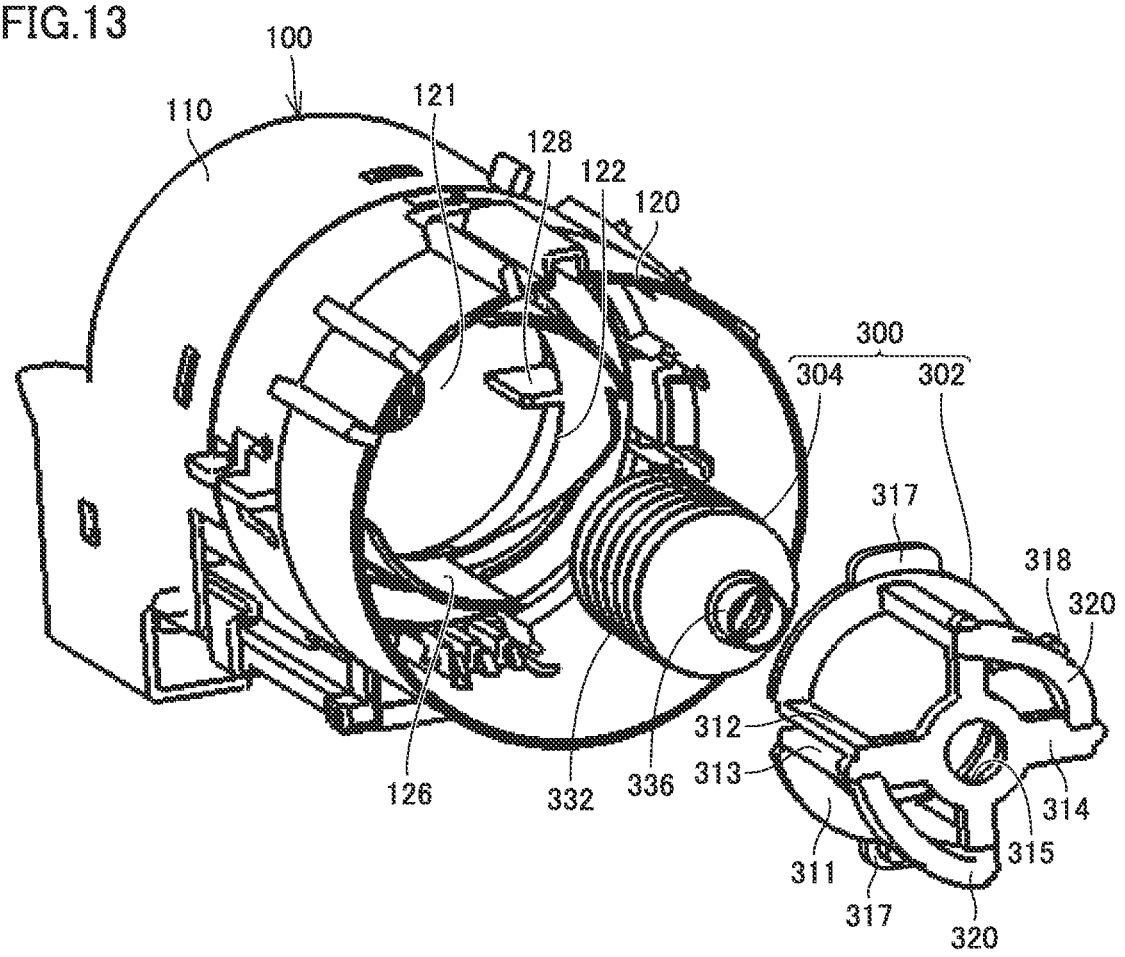
FIG. 13 is an exploded perspective view of a containing cover portion and a discharge mechanism.
Figure 14:
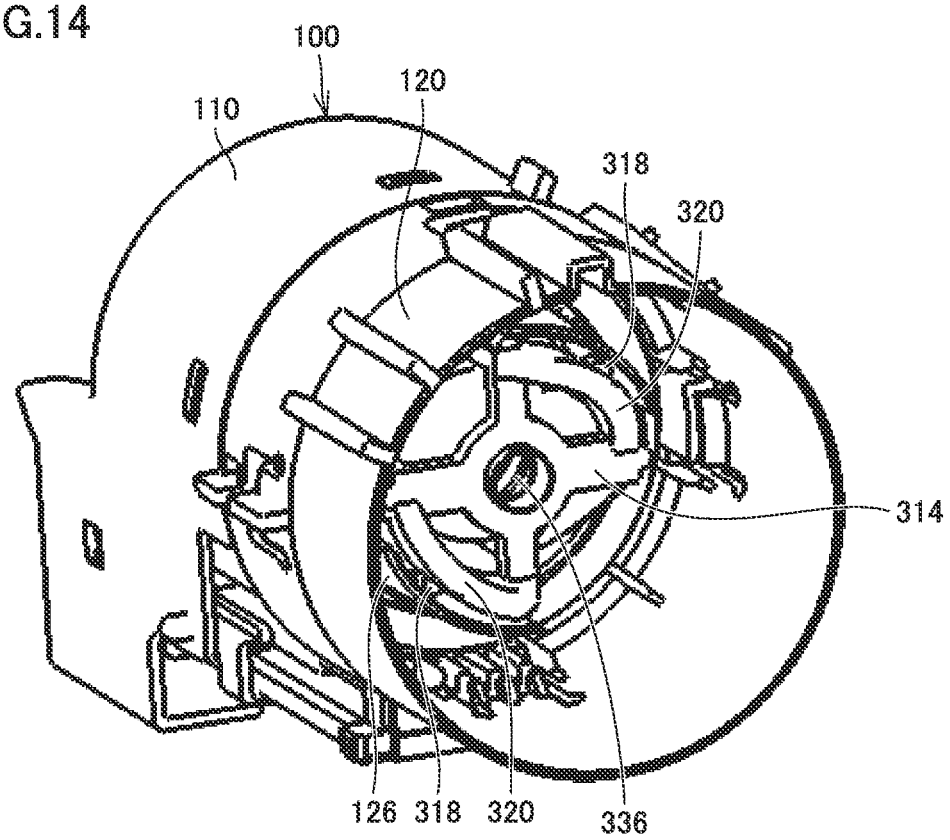
FIG. 14 is a perspective view showing the discharge mechanism incorporated into the containing cover portion in FIG. 13.
Figure 15:
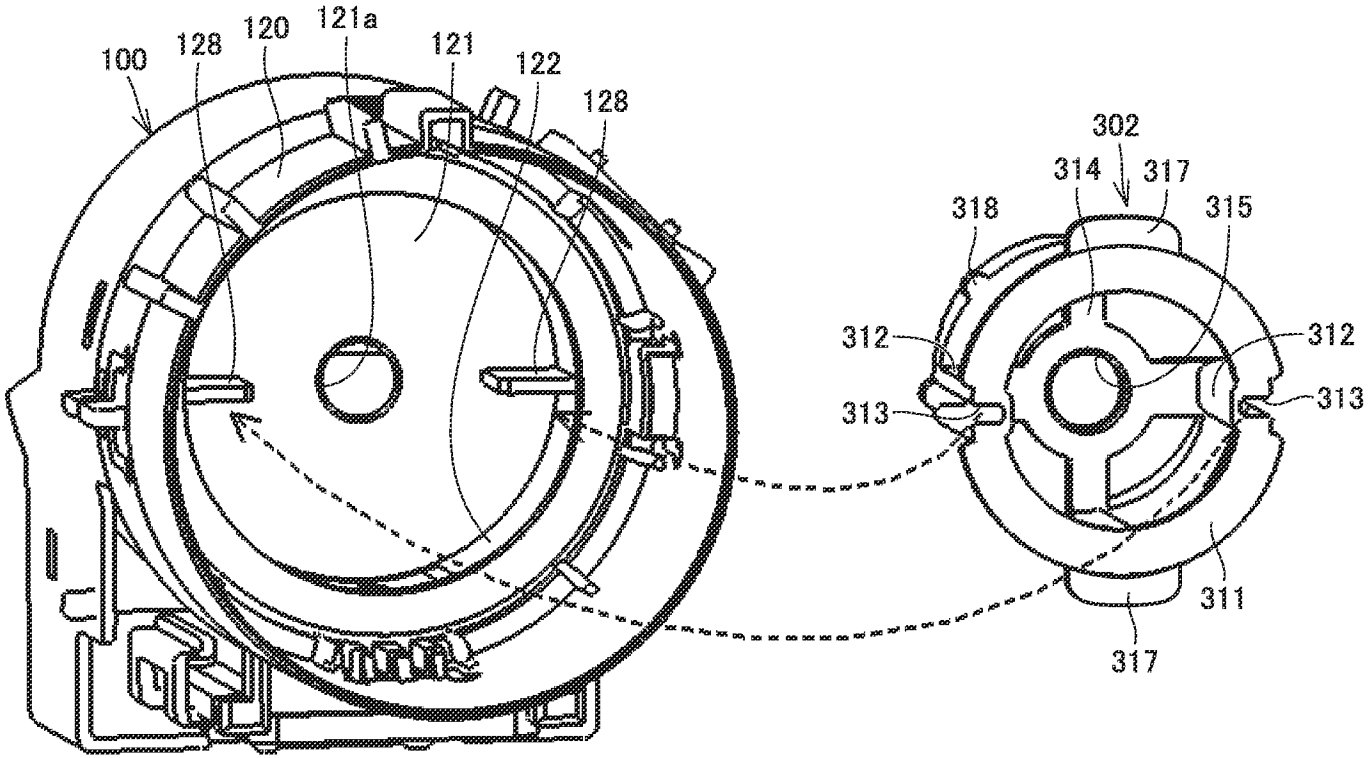
FIG. 15 is a perspective view showing relation between the containing cover portion and the cam member.
Figure 16:
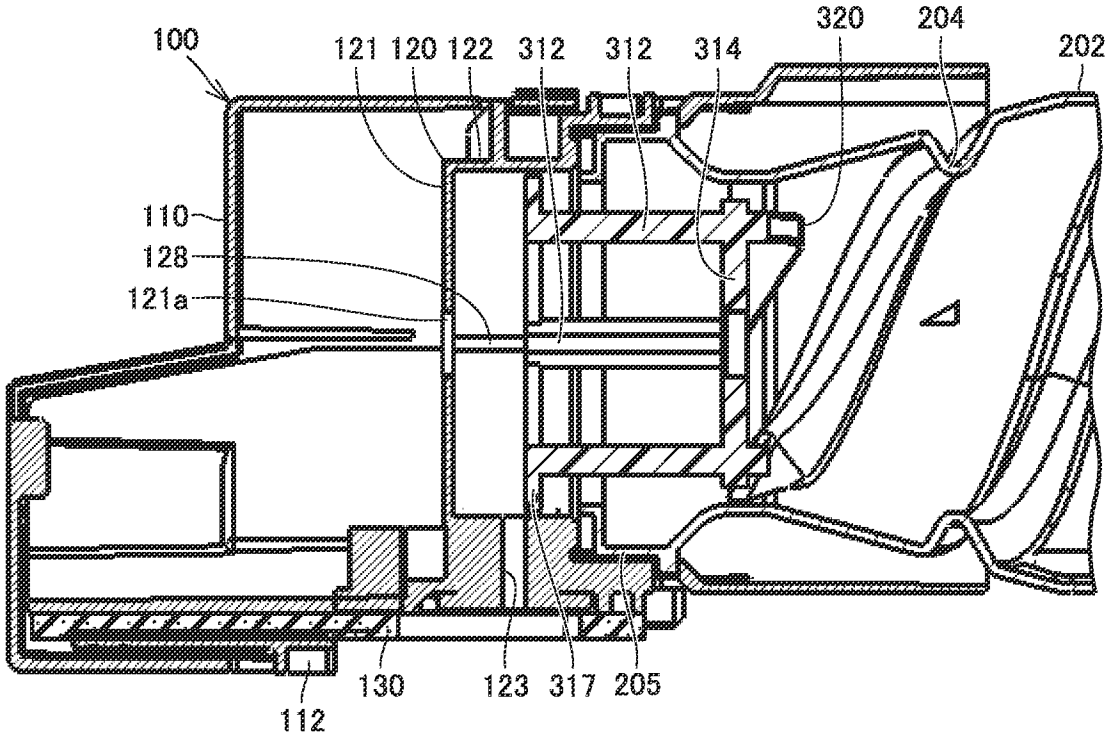
FIG. 16 shows a state in which a biasing member is omitted from FIG. 8.

FIG. 10 is a perspective view of the cam member. FIG. 11 is a plan view of the cam member. FIG. 12 shows a cam portion viewed in a direction indicated by an arrow XII in FIG. 11. FIG. 13 is an exploded perspective view of the containing cover portion and the discharge mechanism. FIG. 14 is a perspective view showing the discharge mechanism incorporated into the containing cover portion in FIG. 13. FIG. 15 is a perspective view showing relation between the containing cover portion and the cam member. FIG. 16 shows a state in which the biasing member is omitted from FIG. 8.

During the rotation of containing portion 200, cam member 302 is displaced relative to containing cover portion 120 along the axial direction of circumferential wall 202 on the inner side of containing cover portion 120, while engaging spiral protrusion 204. As shown in FIGS. 8 and 9, during the rotation of containing portion 200, cam member 302 reciprocates within containing cover portion 120 along the axial direction of circumferential wall 202, while engaging spiral protrusion 204 and receiving a biasing force of biasing member 304. As shown in FIGS. 8 to 10, cam member 302 has a cam member body 310 and a cam portion 320.

Cam member body 310 is disposed around biasing member 304. Cam member body 310 has a base 311, a plurality of (in the present embodiment, four) legs 312, a coupling portion 314, reciprocating portions 317, and a plurality of (in the present embodiment, six) protrusions 318.

Base 311 is formed in an annular shape surrounding biasing member 304.

Each leg 312 is shaped to rise from base 311. Cam member body 310 is disposed on the inner side of containing cover portion 120 in such a manner that base 311 faces front wall 121, and each leg 312 extends rearward (to the side opposite to the side on which front wall 121 is located) from base 311. The plurality of legs 312 are disposed at 90 degree intervals along a circumferential direction of base 311.

As shown in FIGS. 10, 13 and 15, each leg 312 has a guided portion 313 to engage guide portion 128. Guided portion 313 is shaped to be recessed inward in a radial direction of base 311 from an outer surface of leg 312. Guided portion 313 is shaped to extend from one end to the other end of leg 312.

Coupling portion 314 couples together the ends of legs 312 opposite to the ends thereof connected to base 311. Specifically, coupling portion 314 couples together the ends of a pair of legs 312 facing each other in the radial direction of base 311 of the plurality of legs 312. Coupling portion 314 is provided with a hole 315 at its center. Hole 315 is formed in a circular shape.

Each reciprocating portion 317 loosens the developer present above discharge port 123 while reciprocating above discharge port 123. Reciprocating portion 317 is connected to an outer circumferential surface of base 311. Reciprocating portion 317 is shaped to protrude along the radial direction of base 311 from a portion of the outer circumferential surface of base 311. However, the direction of protrusion of reciprocating portion 317 from base 311 may be a direction inclined forward or rearward relative to the radial direction of base 311. Reciprocating portion 317 is formed as a plate.

The plurality of protrusions 318 are provided at positions spaced from one another along the circumferential direction of base 311 (a circumferential direction of circumferential wall 202). Each protrusion 318 is shaped to protrude outward in the radial direction of base 311 from a portion of leg 312 that is spaced from base 311 in a longitudinal direction of leg 312 (in the present embodiment, from an outer circumferential surface of cam portion 320 which will be described later, or from an outer surface of the end of leg 312 opposite to the end thereof connected to base 311).

Each protrusion 318 abuts containing cover portion 120 in a radial direction of circumferential wall 202. Specifically, as shown in FIGS. 8, 9 and 14, each protrusion 318 abuts an inner circumferential surface of containing portion holding portion 126 in the radial direction of circumferential wall 202. During the rotation of containing portion 200, each protrusion 318 slides along the axial direction of circumferential wall 202 while abutting the inner circumferential surface of containing portion holding portion 126. As shown in FIG. 11, at least one protrusion 318 is disposed in one of two regions separated at 180 degrees from each other in the circumferential direction of base 311, and at least two protrusions 318 are disposed in the other of the two regions.

Biasing member 304 biases cam member 302 toward spiral protrusion 204 (away from containing cover portion 120). As shown in FIGS. 8 and 9, biasing member 304 couples front wall 121 of containing cover portion 120 and cam member 302 to each other. Biasing member 304 is made of rubber, or an elastic resin material. Biasing member 304 has a bellows portion 332, a closing portion 334, and a mouth portion 336.

Bellows portion 332 extends and contracts in accordance with the reciprocating movement of cam member 302 along the axial direction of circumferential wall 202. Bellows portion 332 can extend and contract in the axial direction of circumferential wall 202, and when in a contracted state (the state shown in FIG. 9), generates a biasing force for moving cam member 302 away from front wall 121 along the axial direction of circumferential wall 202. A discharge channel S for discharging the developer is formed between bellows portion 332 and cam member body 310.

Closing portion 334 is connected to one end of bellows portion 332. Closing portion 334 is shaped to close one opening in bellows portion 332. Closing portion 334 is connected to front wall 121.

Mouth portion 336 is connected to the other end of bellows portion 332. Mouth portion 336 is shaped to communicate the inside and the outside of bellows portion 332 with each other. Mouth portion 336 is formed in a cylindrical shape. Mouth portion 336 is fixed to cam member 302 so as to open into containing portion 200. Specifically, mouth portion 336 is fixed to coupling portion 314 while being inserted into hole 315 in coupling portion 314.

Cam portion 320 is connected to cam member body 310. Cam portion 320 engages spiral protrusion 204. Cam portion 320 is shaped to displace (push) cam member body 310 toward front wall 121 of containing cover portion 120 along the axial direction of circumferential wall 202 while resisting the biasing force of bellows portion 332 of biasing member 304, while engaging spiral protrusion 204 during the rotation of containing portion 200. The pushing of cam member body 310 by cam portion 320 causes the contraction of bellows portion 332. Cam portion 320 is shaped to displace cam member body 310 away from front wall 121 of containing cover portion 120 along the axial direction of circumferential wall 202 by the biasing force of bellows portion 332 of biasing member 304, while engaging spiral protrusion 204 during the rotation of containing portion 200.

As shown in FIGS. 10, 11, 13 and the like, a pair of cam portions 320 is connected to cam member body 310. Each cam portion 320 is shaped to connect together the upper ends of legs 312 adjacent to each other in the circumferential direction of base 311. Each cam portion 320 has a curved shape protruding outward in the radial direction of base 311. The pair of cam portions 320 is provided at positions facing each other in the radial direction of base 311. As shown in FIGS. 10 and 12, cam portion 320 has a first inclined portion 321 and a second inclined portion 322.

First inclined portion 321 is disposed upstream in the direction of rotation of spiral protrusion 204. First inclined portion 321 is inclined relative to an orthogonal plane (the surface of coupling portion 314) orthogonal to the central axis of circumferential wall 202. First inclined portion 321 has an inclined shape to engage spiral protrusion 204 during the rotation of containing portion 200 to thereby displace cam member body 310 toward front wall 121 of containing cover portion 120 along the axial direction of circumferential wall 202.

Second inclined portion 322 is disposed downstream in the direction of rotation of spiral protrusion 204. Second inclined portion 322 is inclined relative to the aforementioned orthogonal plane. The direction of inclination of second inclined portion 322 relative to the aforementioned orthogonal plane is opposite to that of first inclined portion 321. Second inclined portion 322 has an inclined shape to displace cam member body 310 away from front wall 121 of containing cover portion 120 along the axial direction of circumferential wall 202 by the biasing force of bellows portion 332, while engaging spiral protrusion 204 during the rotation of containing portion 200. As shown in FIG. 12, an angle of inclination $\theta 2$ of second inclined portion 322 relative to the aforementioned orthogonal plane is greater than an angle of inclination $\theta 1$ of first inclined portion 321 relative to the aforementioned orthogonal plane.

During the rotation of containing portion 200, between the time when spiral protrusion 204 moves away from second inclined portion 322 and the time when spiral protrusion 204 engages first inclined portion 321 again (while spiral protrusion 204 is disengaged from cam portion 320), cam member 302 is maintained at a position spaced from front wall 121 by the biasing force of bellows portion 332.

Next, operation is described when the drive unit of developer supply device 50 is driven while developer replenishment container 60 is mounted on container receiver 52.

When the drive unit is driven while fitting protrusion 55 of rotational force transmission unit 54 is fitted into rotational force input portion 207 (the state shown in FIG. 3), the developer in containing portion 200 is conveyed toward discharge port 123 by spiral protrusion 204 formed on circumferential wall 202.

At this time, a downstream portion of spiral protrusion 204 (portion on the held portion 205 side) first engages first inclined portion 321 of cam portion 320. While the downstream portion of spiral protrusion 204 engages first inclined portion 321 (while the downstream portion of spiral protrusion 204 slides over first inclined portion 321), cam member 302 is displaced toward front wall 121 while resisting the biasing force of bellows portion 332 of biasing member 304.

During the displacement of cam member 302 toward front wall 121, guided portion 313 is guided by guide portion 128. Thus, the rotation of cam member 302 relative to containing cover portion 120 is suppressed. Accordingly, the rotational force inputted to containing portion 200 from the drive unit of developer supply device 50 is effectively transmitted to cam member 302 through spiral protrusion 204.

In addition, during the displacement of cam member 302 toward front wall 121, each protrusion 318 continues to abut the inner circumferential surface of containing portion holding portion 126. Thus, the displacement of cam member 302 in the radial direction of circumferential wall 202 is effectively regulated. Accordingly, during the displacement of cam member 302 along the axial direction of circumferential wall 202, the inclination of cam member 302 relative to the axial direction of circumferential wall 202 (occurrence of torsion) is suppressed.

Moreover, the displacement of cam member 302 toward front wall 121 causes the contraction of bellows portion 332. At this time, as indicated by an arrow A in FIG. 9, the air inside bellows portion 332 flows into containing portion 200. As a result, the developer in containing portion 200 is effectively loosened.

When containing portion 200 rotates further from the contracted state of bellows portion 332, the downstream portion of spiral protrusion 204 is disengaged from first inclined portion 321 and engages second inclined portion 322. More specifically, with the downstream portion of spiral protrusion 204 engaging second inclined portion 322, cam member 302 is displaced away from front wall 121 (rearward) by the biasing force of bellows portion 332.

Here, since angle of inclination θ2 is greater than angle of inclination θ1, cam member 302 is displaced away from front wall 121 at a rate greater than the rate at which cam member body 310 is displaced toward front wall 121 by the engagement of spiral protrusion 204 and first inclined portion 321. As a result, the flow of the developer into discharge channel S (the channel formed between bellows portion 332 and cam member body 310) is facilitated. At this time, the developer that has flown into discharge channel S is loosened by an extended outer circumferential surface of bellows portion 332. In addition, at this time (during the extension of bellows portion 332), the developer flows into bellows portion 332 through mouth portion 336 in biasing member 304.

Then, when containing portion 200 rotates further, spiral protrusion 204 engages first inclined portion 321 again, causing cam member 302 to be displaced toward front wall 121 again. At this time, mainly base 311 of cam member body 310 delivers the developer loosened by bellows portion 332 toward discharge port 123. In addition, at this time (during the contraction of bellows portion 332), the developer present in bellows portion 332 is released into containing portion 200 through mouth portion 336 together with the air flowing from bellows portion 332, while being loosened by a contracted inner circumferential surface of bellows portion 332.

As described above, in developer replenishment container 60 of the present embodiment, the developer that has flown into discharge channel S in accordance with the reciprocating movement of cam member 302 resulting from the rotation of containing portion 200 is delivered to discharge port 123 while being loosened by the extended and contracted outer circumferential surface of bellows portion 332. Thus, the occurrence of clogging of discharge port 123 with the developer is suppressed.

Moreover, the developer that has flown into bellows portion 332 in the course of extension and contraction of this bellows portion 332 is released into containing portion 200 while being loosened by the inner circumferential surface of bellows portion 332. Thus, the occurrence of clogging of discharge port 123 is more reliably suppressed.

It is therefore possible, for example, to reduce the size of discharge port 123. The size reduction of discharge port 123 lowers the risk that the developer that has flown out through discharge port 123 may adhere to container receiver 52 during the detachment of developer replenishment container 60 from container receiver 52.

Furthermore, in the course of reciprocating movement of cam member 302 along the axial direction of circumferential wall 202 in accordance with the rotation of containing portion 200, reciprocating portion 317 loosens the developer present above discharge port 123 while reciprocating above discharge port 123. Thus, the deposition of the developer above discharge port 123 is suppressed.

Second Embodiment

Figure 17:
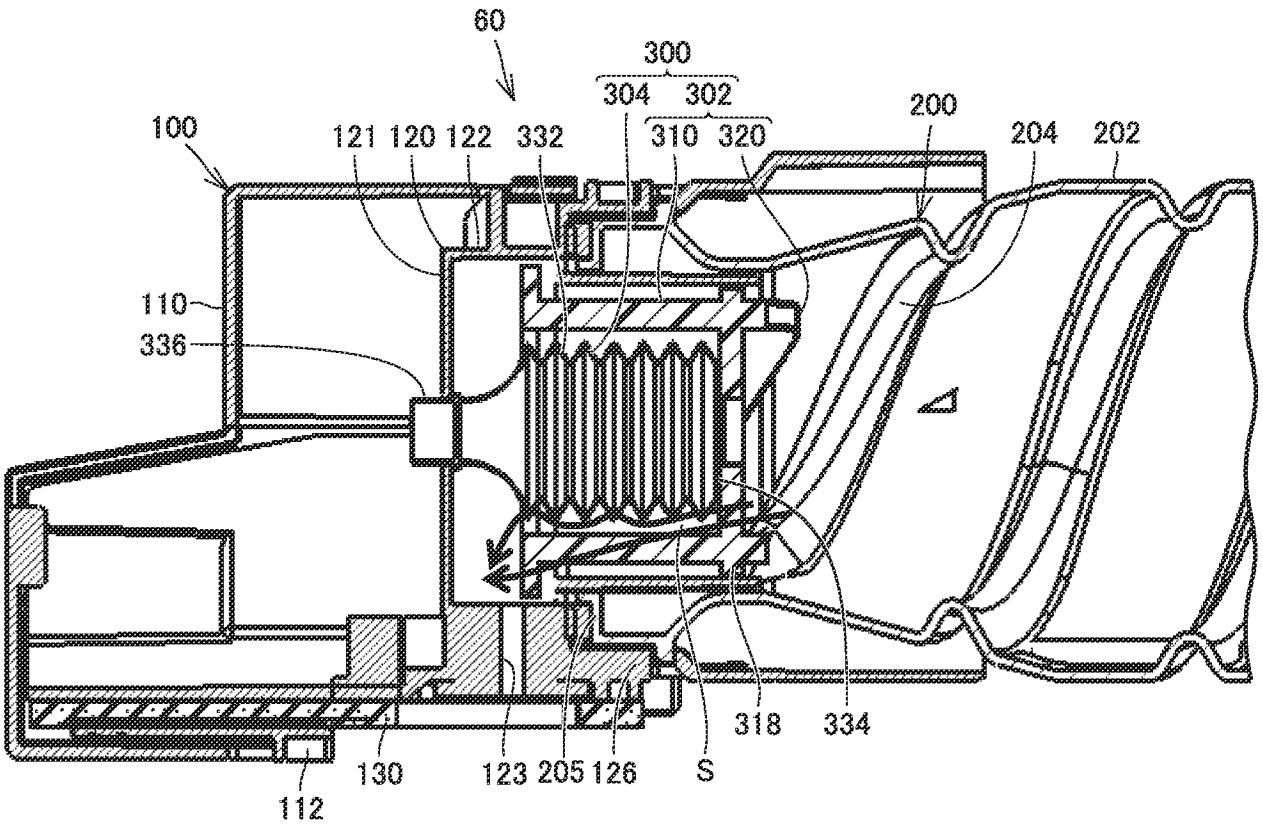
FIG. 17 is a cross-sectional view of the developer replenishment container of a second embodiment of the present invention.
Figure 18:
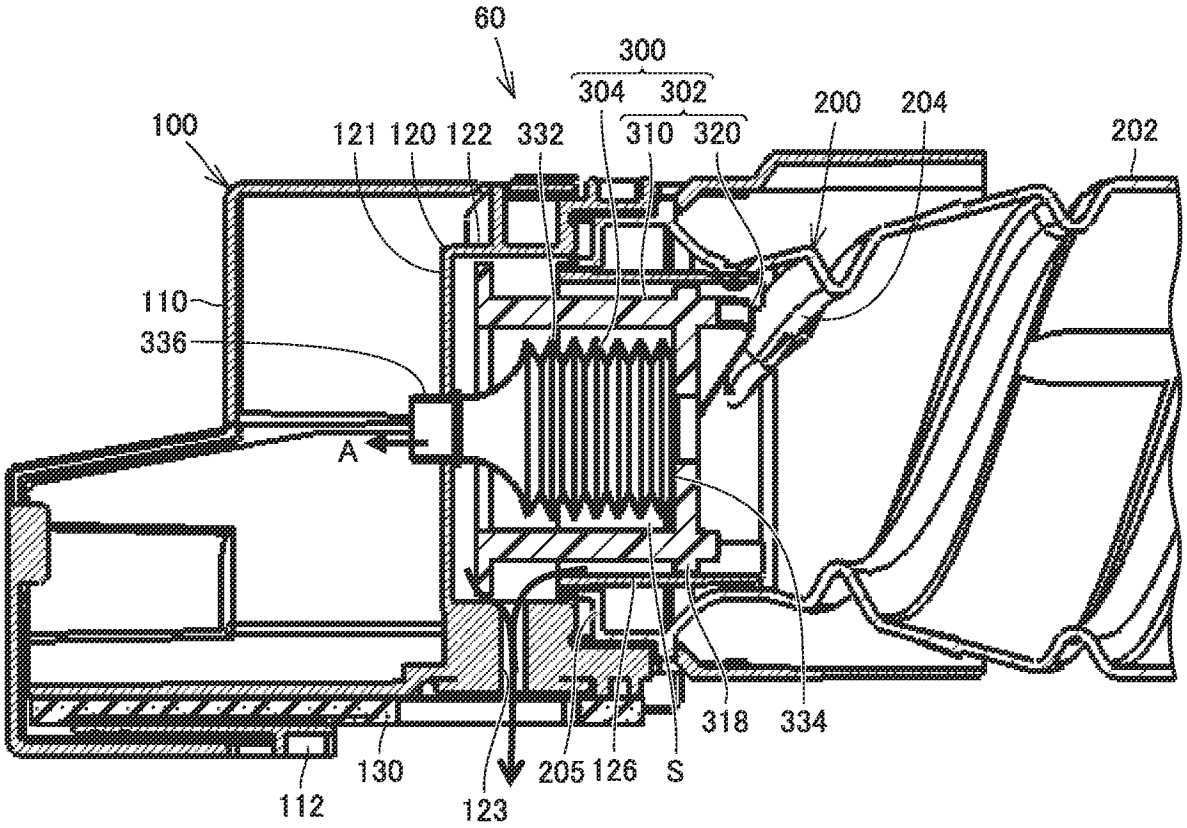
FIG. 18 shows the bellows portion in a contracted state in FIG. 17.
Figure 19:
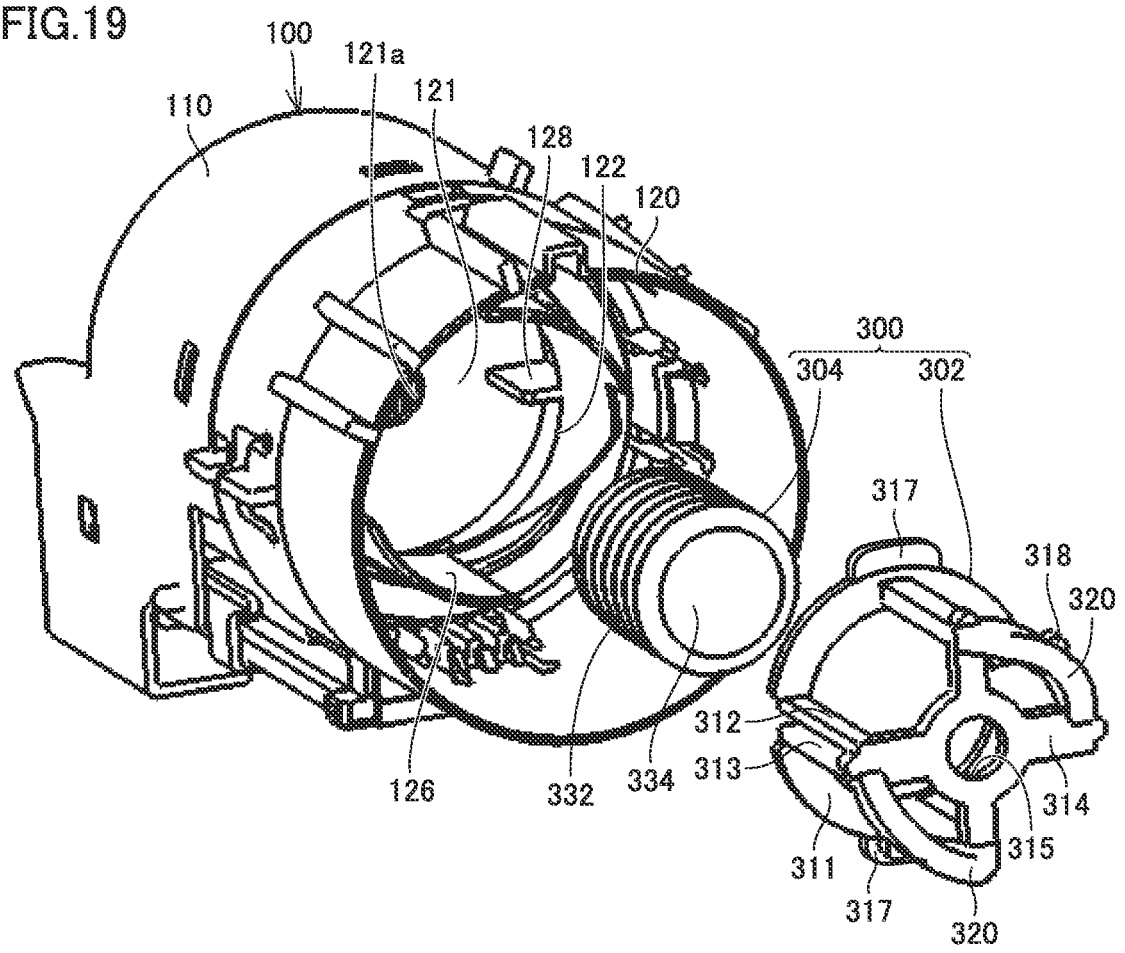
FIG. 19 is an exploded perspective view of the containing cover portion and the discharge mechanism.

Referring now to FIGS. 17 to 19, developer replenishment container 60 of a second embodiment of the present invention is described. FIG. 17 is a cross-sectional view of the developer replenishment container of the second embodiment of the present invention. FIG. 18 shows the bellows portion in a contracted state in FIG. 17. FIG. 19 is an exploded perspective view of the containing cover portion and the discharge mechanism. It should be noted that the second embodiment will only describe portions different from those of the first embodiment, and will not repeat the description of the same structure, function and effect as those of the first embodiment.

In the present embodiment, the manner of attachment of biasing member 304 to front wall 121 and cam member body 310 is reversed from that of the first embodiment. That is, closing portion 334 is fixed to coupling portion 314 of cam member 302. Mouth portion 336 is fixed to containing cover portion 120 so as to open outside of this containing cover portion 120 (into operation cover portion 110). Specifically, as shown in FIGS. 15, 16 and 19, front wall 121 is provided with a hole 121*a* at its center, and mouth portion 336 is fixed to front wall 121 while being inserted into this hole 121*a*. Similarly to hole 315, hole 121*a* is formed in a circular shape.

In the present embodiment, as indicated by an arrow A in FIG. 18, when bellows portion 332 contracts, the air inside bellows portion 332 flows out of containing cover portion 120 (into operation cover portion 110). Smooth contracting action of bellows portion 332 is ensured in this mode.

The configuration of the developer replenishment container described above, and the effect provided by that developer replenishment container are summarized as follows.

A developer replenishment container attachable to and detachable from a container receiver of a developer supply device is provided. This developer replenishment container includes: a containing cover portion having a discharge port through which to discharge a developer; a containing portion configured to contain the developer and held by the containing cover portion so as to be able to rotate relative to the containing cover portion; and a discharge mechanism configured to deliver the developer in the containing portion to the discharge port while loosening the developer. The containing portion has a circumferential wall formed in a cylindrical shape, and a rotational force input portion configured to receive a rotational force for rotating the circumferential wall around its axis from a drive unit of the developer supply device. The circumferential wall is provided with a spiral protrusion shaped to protrude inward and extend spirally. The discharge mechanism has a cam member displaceable along an axial direction of the circumferential wall on an inner side of the containing cover portion while engaging the spiral protrusion during rotation of the containing portion, and a biasing member including a bellows portion configured to generate a biasing force for biasing the cam member toward the spiral protrusion. A discharge channel connecting an inside of the containing portion and the discharge port and configured to discharge the developer is formed between the cam member and the bellows portion. The bellows portion is configured to extend and contract in accordance with reciprocating movement of the cam member along the axial direction of the circumferential wall.

In this developer replenishment container, the containing portion rotates by the rotational force from the drive unit of the developer supply device, causing the cam member to reciprocate along the axial direction of the circumferential wall on the inner side of the containing cover portion, while engaging the spiral protrusion and receiving the biasing force from the bellows portion. At this time, the developer conveyed to the outside of the containing portion by the spiral protrusion in accordance with the rotation of the containing portion flows into the discharge channel formed between the cam member and the bellows portion. The developer that has flown into the discharge channel is delivered to the discharge port while being loosened by an extended and contracted outer circumferential surface of the bellows portion. Thus, the occurrence of clogging of the discharge port with the developer is suppressed.

Preferably, the biasing member has a closing portion configured to close one opening in the bellows portion in an axial direction of the bellows portion, and a mouth portion configured to open the other opening in the bellows portion in the axial direction of the bellows portion. The mouth portion may be fixed to the cam member so as to open into the containing portion.

In this mode, the air inside the bellows portion flows through the mouth portion toward the containing portion during the contraction of the bellows portion. Thus, the developer in the containing portion is effectively loosened. Furthermore, the developer flows into the bellows portion through the mouth portion, and that developer is released through the mouth portion while being loosened by the extending and contracting action of the bellows portion. Thus, the occurrence of clogging of the discharge port is more reliably suppressed.

Alternatively, the closing portion may be fixed to the cam member, and the mouth portion may be fixed to the containing cover portion so as to open outside of the containing cover portion.

In this mode, smooth contracting action of the bellows portion is ensured.

Preferably, the bellows portion is made of rubber, or an elastic resin material.

Preferably, the containing cover portion has a guide portion shaped to extend along the axial direction of the circumferential wall. The cam member has a guided portion configured to engage the guide portion.

Accordingly, the rotation of the cam member relative to the containing cover portion is suppressed. Thus, the rotational force inputted to the containing portion from the drive unit of the developer supply device is effectively transmitted to the cam member through the spiral protrusion.

Preferably, the cam member has a reciprocating portion configured to loosen the developer present above the discharge port while reciprocating above the discharge port in accordance with extension and contraction of the bellows portion.

Accordingly, the deposition of the developer above the discharge port can be suppressed.

Preferably, the cam member has a cam member body disposed around the biasing member, and a cam portion connected to the cam member body and configured to engage the spiral protrusion.

Accordingly, the bellows portion can be held stably by the cam member body.

More preferably, the cam portion has a first inclined portion disposed upstream in a direction of rotation of the spiral protrusion and shaped to engage the spiral protrusion to thereby displace the cam member body toward the containing cover portion along the axial direction of the circumferential wall, and a second inclined portion disposed downstream in the direction of rotation of the spiral protrusion and shaped to displace the cam member body away from the containing cover portion along the axial direction of the circumferential wall by the biasing force of the bellows portion. An angle of inclination of the second inclined portion relative to a plane orthogonal to a central axis of the circumferential wall is greater than an angle of inclination of the first inclined portion relative to the plane orthogonal to the central axis of the circumferential wall.

Accordingly, the rate at which the cam member body is displaced away from the containing cover portion after the spiral protrusion is disengaged from the first inclined portion is greater than the rate at which the cam member body is displaced toward the containing cover portion by the engagement of the spiral protrusion and the first inclined portion. Thus, the flow of the developer into the discharge channel is facilitated.

Preferably, the cam member has a plurality of protrusions provided at positions spaced from one another along a circumferential direction of the circumferential wall and each configured to abut the containing cover portion in a radial direction of the circumferential wall.

Accordingly, the displacement of the cam member in the radial direction of the circumferential wall is effectively regulated. Thus, during the displacement of the cam member along the axial direction of the circumferential wall, the inclination of the cam member relative to the axial direction of the circumferential wall (occurrence of torsion) is suppressed.

Although embodiments of the present invention have been described and illustrated in detail, the disclosed embodiments are made for purposes of illustration and example only and not limitation. The scope of the present invention should be interpreted by terms of the appended claims.

What is claimed is:

1. A developer replenishment container attachable to and detachable from a container receiver of a developer supply device, the developer replenishment container comprising:

a containing cover portion having a discharge port through which to discharge a developer;

a containing portion configured to contain the developer and held by the containing cover portion so as to be able to rotate relative to the containing cover portion; and a discharge mechanism configured to deliver the developer in the containing portion to the discharge port while loosening the developer, the containing portion having a circumferential wall formed in a cylindrical shape, and a rotational force input portion configured to receive a rotational force for rotating the circumferential wall around its axis from a drive unit of the developer supply device, the circumferential wall being provided with a spiral protrusion shaped to protrude inward and extend spirally, the discharge mechanism having a cam member displaceable along an axial direction of the circumferential wall on an inner side of the containing cover portion while engaging the spiral protrusion during rotation of the containing portion, and a biasing member including a bellows portion configured to generate a biasing force for biasing the cam member toward the spiral protrusion, a discharge channel connecting an inside of the containing portion and the discharge port and configured to discharge the developer being formed between the cam member and the bellows portion, and the bellows portion being configured to extend and contract in accordance with reciprocating movement of the cam member along the axial direction of the circumferential wall, wherein the cam member has a cam member body disposed around the biasing member, and a cam portion connected to the cam member body and configured to engage the spiral protrusion.

2. The developer replenishment container according to claim 1, wherein the biasing member has a closing portion configured to close one opening in the bellows portion in an axial direction of the bellows portion, and a mouth portion configured to open the other opening in the bellows portion in the axial direction of the bellows portion, and the mouth portion is fixed to the cam member so as to open into the containing portion.

3. The developer replenishment container according to claim 1, wherein the biasing member has a closing portion configured to close one opening in the bellows portion in an axial direction of the bellows portion, and a mouth portion configured to open the other opening in the bellows portion in the axial direction of the bellows portion, the closing portion is fixed to the cam member, and the mouth portion is fixed to the containing cover portion so as to open outside of the containing cover portion.

4. The developer replenishment container according to claim 1, wherein the bellows portion is made of rubber, or an elastic resin material.

5. The developer replenishment container according to claim 1, wherein the containing cover portion has a guide portion shaped to extend along the axial direction of the circumferential wall, and the cam member has a guided portion configured to engage the guide portion.

6. The developer replenishment container according to claim 1, wherein the cam member has a reciprocating portion configured to loosen the developer present above the discharge port while reciprocating above the discharge port in accordance with extension and contraction of the bellows portion.

7. The developer replenishment container according to claim 1, wherein the cam portion has a first inclined portion disposed upstream in a direction of rotation of the spiral protrusion and shaped to engage the spiral protrusion to thereby displace the cam member body toward the containing cover portion along the axial direction of the circumferential wall, and a second inclined portion disposed downstream in the direction of rotation of the spiral protrusion and shaped to displace the cam member body away from the containing cover portion along the axial direction of the circumferential wall by the biasing force of the bellows portion, and an angle of inclination of the second inclined portion relative to a plane orthogonal to a central axis of the circumferential wall is greater than an angle of inclination of the first inclined portion relative to the plane orthogonal to the central axis of the circumferential wall.

8. The developer replenishment container according to claim 1, wherein the cam member has a plurality of protrusions provided at positions spaced from one another along a circumferential direction of the circumferential wall and each configured to abut the containing cover portion in a radial direction of the circumferential wall.

9. A developer replenishment container attachable to and detachable from a container receiver of a developer supply device, the developer replenishment container comprising:

a containing cover portion having a discharge port through which to discharge a developer;

a containing portion configured to contain the developer and held by the containing cover portion so as to be able to rotate relative to the containing cover portion; and a discharge mechanism configured to deliver the developer in the containing portion to the discharge port while loosening the developer, the containing portion having a circumferential wall formed in a cylindrical shape, and a rotational force input portion configured to receive a rotational force for rotating the circumferential wall around its axis from a drive unit of the developer supply device, the circumferential wall being provided with a spiral protrusion shaped to protrude inward and extend spirally, the discharge mechanism having a cam member displaceable along an axial direction of the circumferential wall on an inner side of the containing cover portion while engaging the spiral protrusion during rotation of the containing portion, and a biasing member including a bellows portion configured to generate a biasing force for biasing the cam member toward the spiral protrusion, a discharge channel connecting an inside of the containing portion and the discharge port and configured to discharge the developer being formed between the cam member and the bellows portion, and the bellows portion being configured to extend and contract in accordance with reciprocating movement of the cam member along the axial direction of the circumferential wall, wherein the biasing member has a closing portion configured to close one opening in the bellows portion in an axial direction of the bellows portion, and a mouth portion configured to open the other opening in the bellows portion in the axial direction of the bellows portion, and the mouth portion is fixed to the cam member so as to open into the containing portion.

10. The developer replenishment container according to claim 9, wherein the bellows portion is made of rubber, or an elastic resin material.

11. The developer replenishment container according to claim 9, wherein the containing cover portion has a guide portion shaped to extend along the axial direction of the circumferential wall, and the cam member has a guided portion configured to engage the guide portion.

12. The developer replenishment container according to claim 9, wherein the cam member has a reciprocating portion configured to loosen the developer present above the discharge port while reciprocating above the discharge port in accordance with extension and contraction of the bellows portion.

13. The developer replenishment container according to claim 9, wherein the cam member has a plurality of protrusions provided at positions spaced from one another along a circumferential direction of the circumferential wall and each configured to abut the containing cover portion in a radial direction of the circumferential wall.

14. A developer replenishment container attachable to and detachable from a container receiver of a developer supply device, the developer replenishment container comprising:

a containing cover portion having a discharge port through which to discharge a developer;

a containing portion configured to contain the developer and held by the containing cover portion so as to be able to rotate relative to the containing cover portion; and a discharge mechanism configured to deliver the developer in the containing portion to the discharge port while loosening the developer, the containing portion having a circumferential wall formed in a cylindrical shape, and a rotational force input portion configured to receive a rotational force for rotating the circumferential wall around its axis from a drive unit of the developer supply device, the circumferential wall being provided with a spiral protrusion shaped to protrude inward and extend spirally, the discharge mechanism having a cam member displaceable along an axial direction of the circumferential wall on an inner side of the containing cover portion while engaging the spiral protrusion during rotation of the containing portion, and a biasing member including a bellows portion configured to generate a biasing force for biasing the cam member toward the spiral protrusion, a discharge channel connecting an inside of the containing portion and the discharge port and configured to discharge the developer being formed between the cam member and the bellows portion, and the bellows portion being configured to extend and contract in accordance with reciprocating movement of the cam member along the axial direction of the circumferential wall, wherein the biasing member has a closing portion configured to close one opening in the bellows portion in an axial direction of the bellows portion, and a mouth portion configured to open the other opening in the bellows portion in the axial direction of the bellows portion, the closing portion is fixed to the cam member, and the mouth portion is fixed to the containing cover portion so as to open outside of the containing cover portion.

15. The developer replenishment container according to claim 14, wherein the bellows portion is made of rubber, or an elastic resin material.

16. The developer replenishment container according to claim 14, wherein the containing cover portion has a guide portion shaped to extend along the axial direction of the circumferential wall, and the cam member has a guided portion configured to engage the guide portion.

17. The developer replenishment container according to claim 14, wherein the cam member has a reciprocating portion configured to loosen the developer present above the discharge port while reciprocating above the discharge port in accordance with extension and contraction of the bellows portion.

18. The developer replenishment container according to claim 14, wherein the cam member has a plurality of protrusions provided at positions spaced from one another along a circumferential direction of the circumferential wall and each configured to abut the containing cover portion in a radial direction of the circumferential wall.

* * * * *